US009809342B2

(12) United States Patent
Florentzson et al.

(10) Patent No.: US 9,809,342 B2
(45) Date of Patent: Nov. 7, 2017

(54) DEVICE AND A METHOD FOR IMPROVED FOLDING OF A CONTAINER

(75) Inventors: Markus Florentzson, Staffanstorp (SE); Mats Nyhlén, Löddeköpinge (SE); Johnny Månsson, Hyllinge (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 892 days.

(21) Appl. No.: 13/511,337

(22) PCT Filed: Nov. 12, 2010

(86) PCT No.: PCT/SE2010/000273

§ 371 (c)(1),
(2), (4) Date: Jun. 15, 2012

(87) PCT Pub. No.: WO2011/065884

PCT Pub. Date: Jun. 3, 2011

(65) Prior Publication Data

US 2012/0245008 A1 Sep. 27, 2012

(30) Foreign Application Priority Data

Nov. 24, 2009 (SE) ..... 0901479

(51) Int. Cl.
*B31B 3/00* (2006.01)
*B31B 29/00* (2006.01)
(Continued)

(52) U.S. Cl.
CPC ..... *B65B 61/24* (2013.01); *B65B 9/20* (2013.01)

(58) Field of Classification Search
CPC B31B 3/00; B31B 29/00; B31B 29/60; B31B 37/00; B31B 1/28; B65H 2801/57; B65H 2801/69
(Continued)

(56) References Cited

U.S. PATENT DOCUMENTS 2,196,666 A 4/1940 Moore
3,325,961 A 6/1967 Lindh et al.
(Continued)

FOREIGN PATENT DOCUMENTS

CN 1592701 A 3/2005
EP 1 396 427 A1 3/2004
GB 686078 1/1953

OTHER PUBLICATIONS

Written Opinion of the International Searching Authority (Form PCT/ISA/237) issued on Mar. 11, 2011, in the corresponding International Application No. PCT/SE2010/000273. (6 pages).
(Continued)

*Primary Examiner* — Hemant M Desai
*Assistant Examiner* — Mary Hibbert
(74) *Attorney, Agent, or Firm* — Buchanan Ingersoll & Rooney PC

(57) ABSTRACT

A device for facilitating folding of a container comprising a first flattening element and a second flattening element arranged to flatten a first end portion and a second end portion of a sealed end of the container, respectively. By flattening the first and second end portions, these are made thinner, which, in turn, facilitates folding of the first end portion and the second end portion towards a middle portion of the sealed end, placed between the first end portion and the second end portion.

8 Claims, 10 Drawing Sheets

(51) Int. Cl.
*B31B 29/60* (2006.01)
*B65B 61/24* (2006.01)
*B65B 9/20* (2012.01)

(58) Field of Classification Search
USPC ..... 493/162, 156, 157, 158, 141, 151, 183, 493/186, 218, 219, 423; 53/450, 451
See application file for complete search history.

(56) References Cited

U.S. PATENT DOCUMENTS

RE27,302 E * 2/1972 Schneider et al. ..... 53/451
4,117,649 A * 10/1978 Egli ..... B65B 1/02 493/252
4,462,202 A 7/1984 Reil
4,582,743 A 4/1986 Bahring
5,800,062 A 9/1998 Tobolka
5,966,899 A * 10/1999 Fontanazzi ..... B65B 7/20 53/374.7
6,764,576 B1 * 7/2004 Heinonen et al. ..... 156/379.7
7,156,556 B2 1/2007 Takahashi et al.
2004/0045264 A1 3/2004 Akaho
2008/0121011 A1 5/2008 Petratto
2009/0232424 A1 * 9/2009 Bierschenk ..... B31B 19/36 383/104

OTHER PUBLICATIONS

Notification of Transmittal of the International Search Report and the Written Opinion of the International Searching Authority, or the Declaration (PCT/ISA/220), PCT International Search Report (PCT/ISA/210) issued on Mar. 11, 2011, in corresponding International Application No. PCT/SE2010/000273.
Office Action issued on Jun. 2, 2010 by Swedish Patent Office, in corresponding Swedish Application No. 0901479-6. (5 pages).
International Search Report (PCT/ISA/210) issued on Mar. 11, 2011, by the Swedish Patent Office as the International Searching Authority for International Application No. PCT/SE2010/000273.
Office Action (Notification of the First Office Action) issued on Jul. 1, 2013 by the State Intellectual Property Office of P. R. C. in corresponding Chinese Patent Application No. 201080052899.1, and an English Translation of the Office Action. (12 pages).

* cited by examiner

DEVICE AND A METHOD FOR IMPROVED FOLDING OF A CONTAINER

TECHNICAL FIELD

The invention generally relates to the field of packaging technology. More particularly, the invention relates to a device for facilitating folding of a container, an apparatus comprising the device, and a method for folding the container.

BACKGROUND OF THE INVENTION

An apparatus for packaging pourable food in containers comprise a number of steps. In short, such an apparatus may comprise the steps of forming a tube of a web of packaging material, filling said tube with the pourable food, forming containers from the tube by transversally sealing and cutting the tube, and folding the containers to their final form. Further, the folding step can be divided into a number of sub-steps. For example, during a first folding sub-step performed in association to the sealing and cutting step, a section of the containers being sealed may be formed to have a rectangular cross-section. In later folding sub-steps, the container may be folded in such a way that a rectangular base is achieved, e.g. by folding the outer ends of the sealing end into the middle of the sealing end.

In order to reduce the risk of having leaking containers it is important that the folding is made correctly, since an improper folding can create tensions in the containers, which can result in leaking containers. This is especially important if the packaging material comprises several layers, such as a carton layer, plastic layers and an aluminum foil.

In order to facilitate the folding and thus reduce the risk of improper folding, packaging material having creasing lines may used. However, although packaging material provided with creasing lines is used, there is still a risk that the folding is made improperly.

SUMMARY

In view of the above, an objective of the invention is to solve or at least reduce the problems discussed above. In particular, an objective is to improve a filling machine in such a way that the number of improperly folded containers is reduced.

The general idea is to flatten a first and a second end portion of a sealed end of a container by two flattening elements such that later folding of the first and second end portion towards a middle portion, placed between the first and second end portion, is facilitated.

According to a first aspect a device is provided. The device comprises a first flattening element and a second flattening element arranged to flatten a first end portion and a second end portion of a sealed end of a container, respectively, such that folding of the first end portion and the second end portion towards a middle portion placed between the first end portion and the second end portion is facilitated.

The first flattening element and the second flattening element may be a first flattening wheel and a second flattening wheel, respectively.

The device may further comprise a conveyor belt, placed between the first flattening element and the second flattening element, arranged to hold the middle section of the sealed end down folded.

Further, a speed of the conveyor belt may be equal to a speed of the first flattening element and the second flattening element.

An advantage of having the same speed for the flattening elements and the conveyor belt is that less shear stress is generated in the container.

Moreover, the conveyor belt, the first flattening element and the second flattening element may have a common driving shaft.

The first flattening element and the second flattening element may have a rubber coating. Alternatively, the first flattening element and the second flattening element may be made of rubber.

According to a second aspect an apparatus is provided. The apparatus comprises a conveyor for transporting containers in an upright position, a plate adapted to direct a sealed end of said container into a down folded position during transportation of said container by said conveyor, and a device according to the first aspect.

A speed of the first flattening element and the second flattening element of the device may be equal to a speed of the conveyor.

The apparatus may further comprise rails adapted to direct a first end portion and a second end portion of the sealed end such that the first end portion and the second end portion are bended substantially 90 degrees in relation to a middle portion of the sealed end during transportation of the container by the conveyor.

The conveyor belt of the device may be arranged to hold the middle portion of the sealed end during the first end portion and the second end portion are bended substantially 90 degrees in relation to the middle portion by the rails.

According to a third aspect a method for folding a container is provided. The method comprises flattening a first end portion and a second end portion of a sealed end of said container, and folding the first end portion and the second end portion towards a middle portion of the sealed end.

The middle portion may be held down folded by a conveyor belt during the step of flattening the first end portion and the second end portion of the sealed end of the container.

Further, the step of folding the first end portion and the second end portion towards the middle portion of the sealed end may comprise the sub-step bending the first end portion and the second end portion substantially 90 degrees in relation to the middle portion while the middle portion is held in position by the conveyor belt.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, wherein.

DETAILED DESCRIPTION OF PREFERRED EMBODIMENTS

Figure 1A:
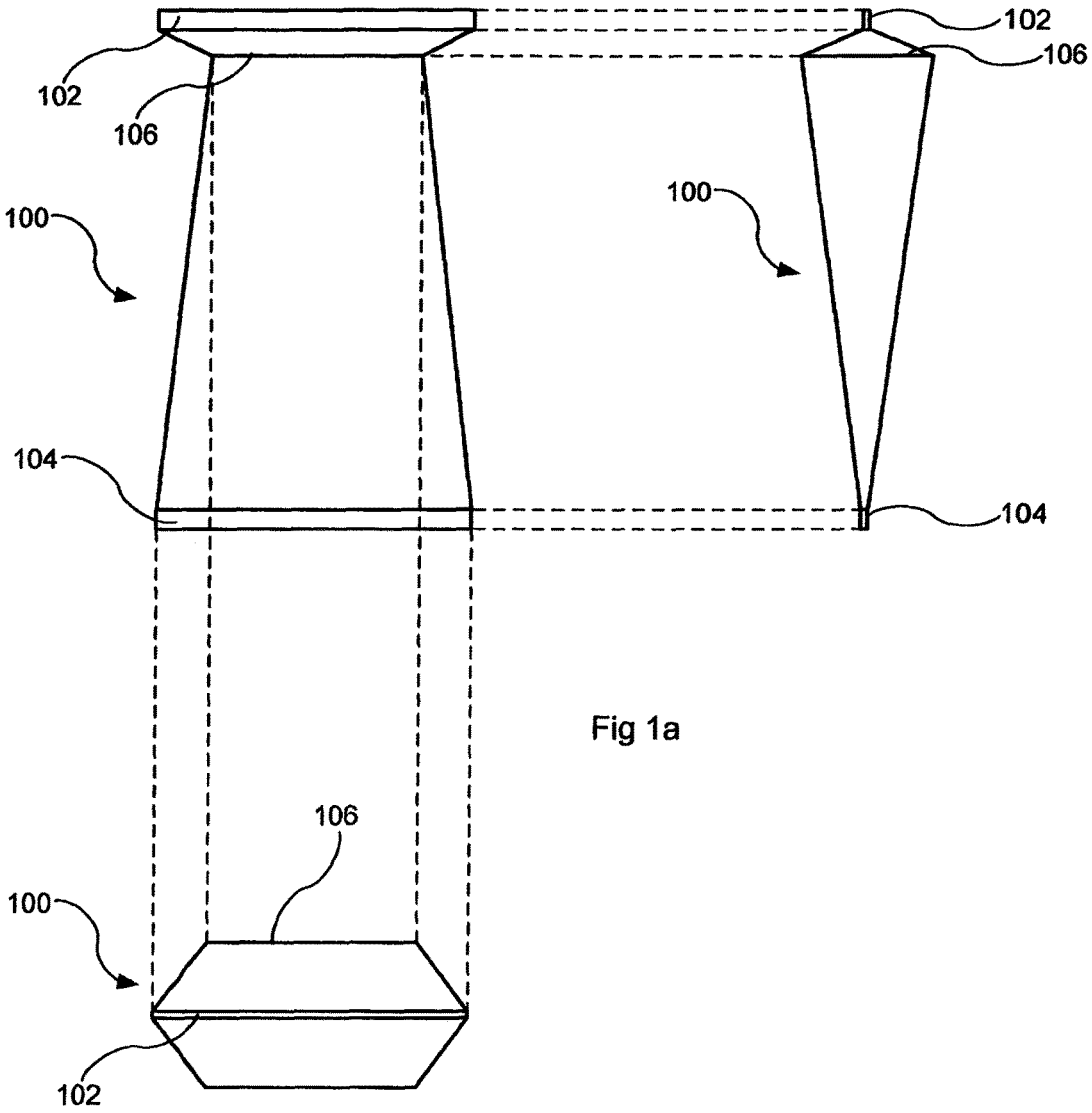
FIG. 1*a*-1*d* illustrate a container during four different folding sub-steps from a first side view, a second side view and seen from above.

After the steps of filling, sealing and cutting have been performed in a filling machine, a container 100 having a first sealing end 102 and a second sealing end 104 can be obtained, as illustrated in FIG. 1*a*. During the filling step, a section 106 of the container 100 may be formed to have a rectangular cross-section.

Figure 1B:
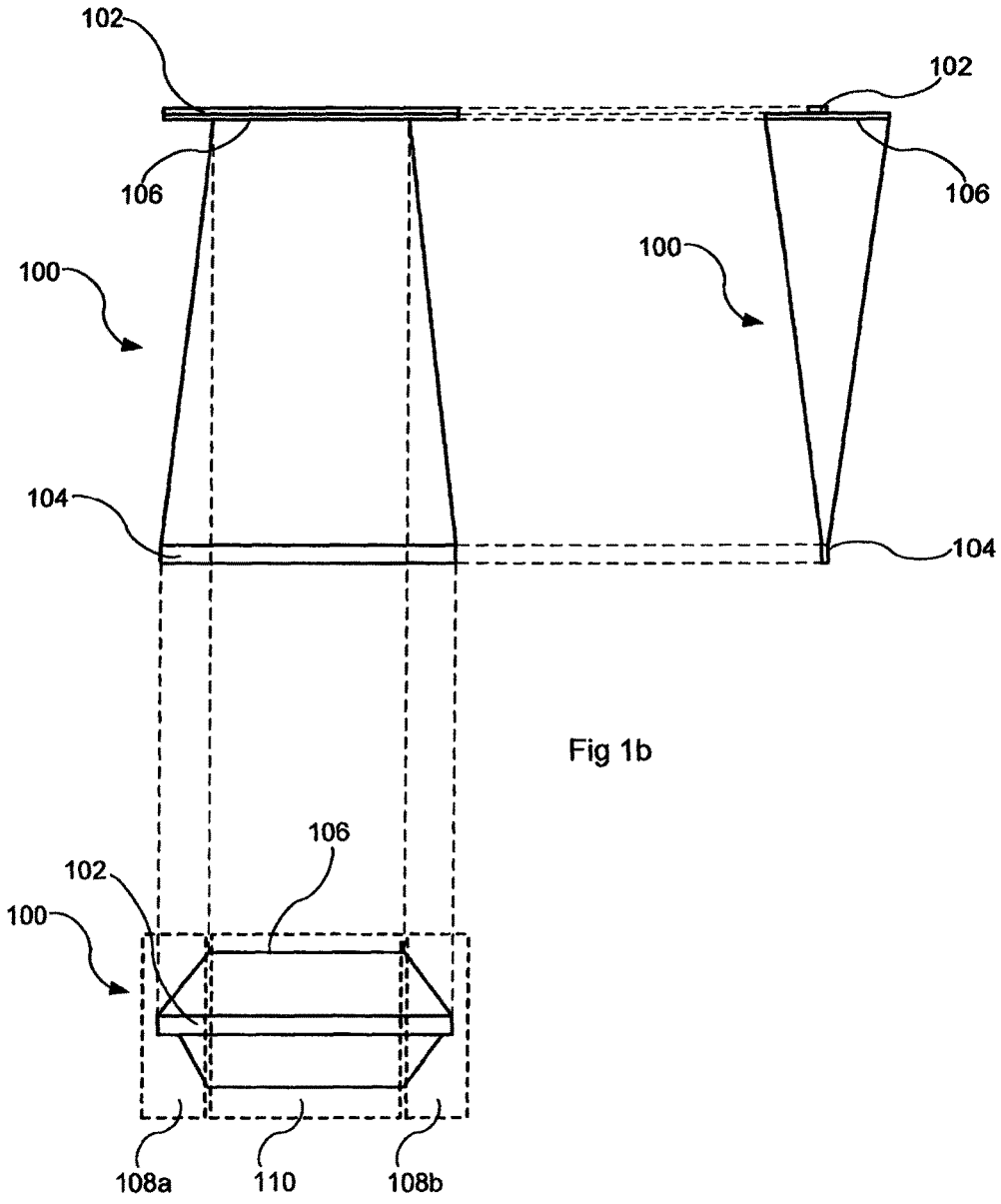

Starting from the section 106, the container 100 may be folded in a number of sub-steps such that a rectangular base is achieved. In a first folding sub-step the first sealing end 102 is down folded and pushed towards the section 106, thereby achieving a substantially flat surface, as illustrated in FIG. 1*b*. The surface may be divided in a first end portion 108*a*, a second end portion 108*b* and a middle portion 110. The first end portion 108*a* and the second end portion 108*b* can be substantially triangular and the middle portion 110 can be substantially rectangular with the same size as the rectangular cross-section of the section 106.

Then, in a pre-folding step, the first end portion 108*a* and the second end portion 108*b* can be flattened by flattening elements. An advantage of flattening the end portions 108*a*, 108*b* is that folding of the outer ends 108*a*, 108*b* towards the middle portion 110 is faciliated, and thereby that the risk of having folding lines not placed in the intersections between the outer ends and the middle portion is reduced.

Figure 1C:
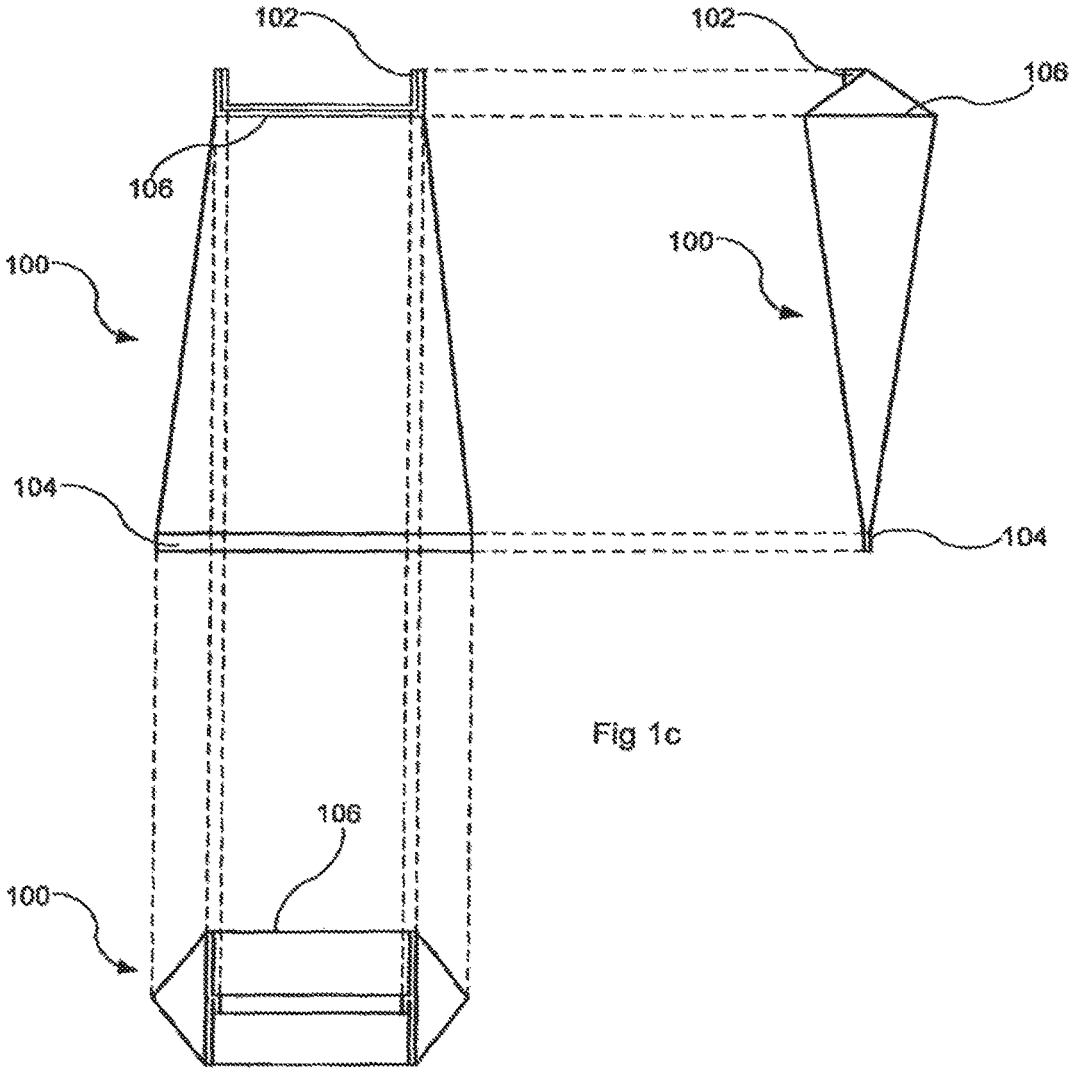

In a next folding sub-step, the first end portion 108*a* and the second end portion 108*b* can be folded such that the first sealing end 102 is bended about 90 degrees in an intersection between the first end portion 108*a* and the middle portion 110, and in an intersection between the second end portion 108*b* and the middle portion 110, as illustrated in FIG. 1*c*.

Figure 1D:
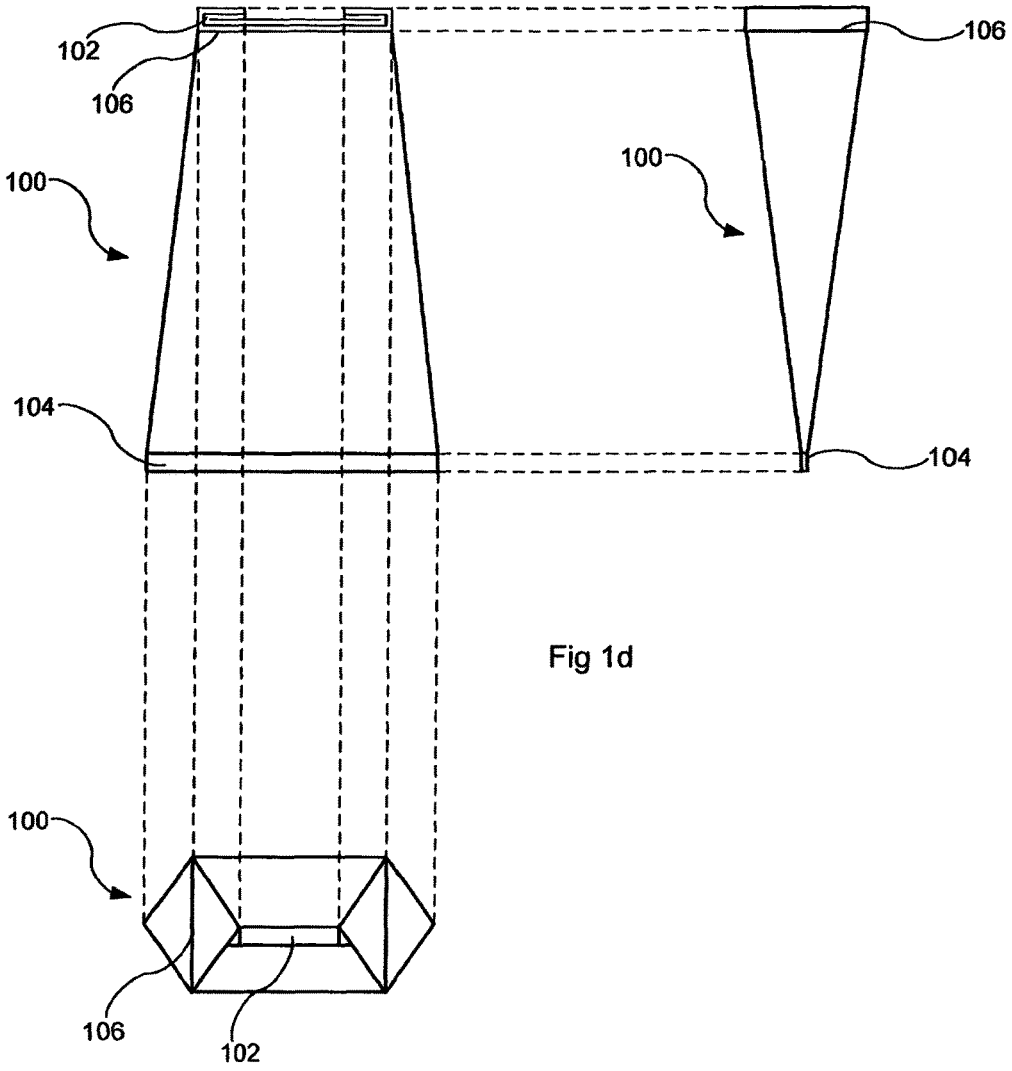
Figure 2:
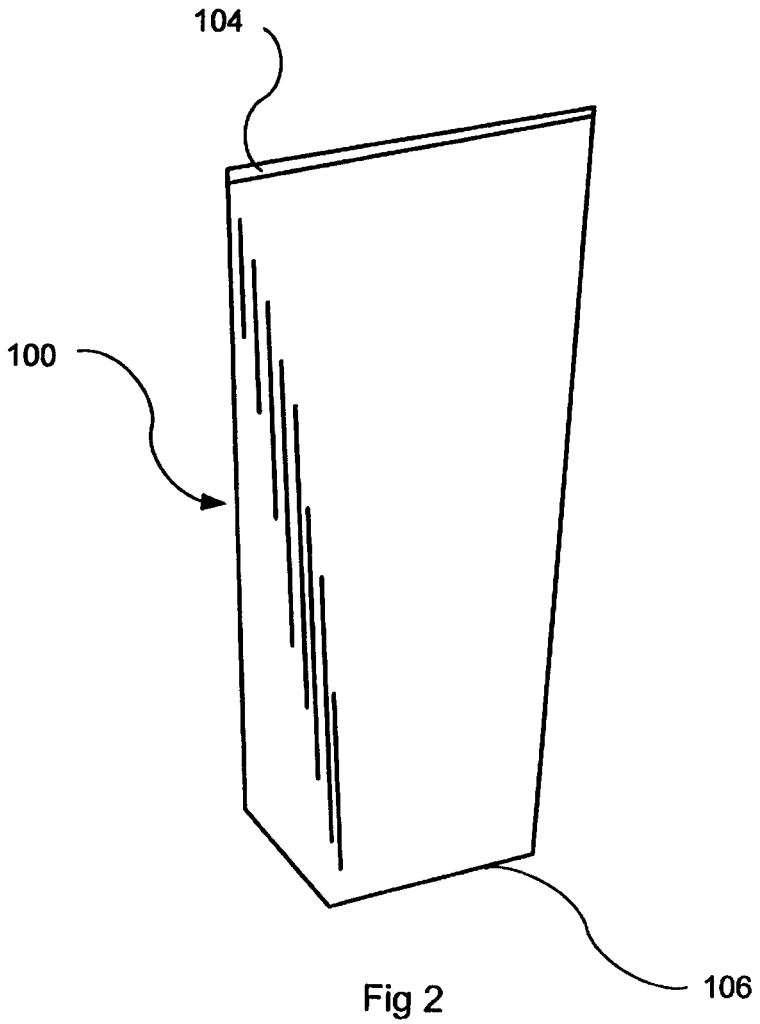
FIG. 2 illustrates the final form of the container.

Finally, in the last folding sub-step, the first end portion 108*a* and the second end portion 108*b* can be folded inwardly towards the middle portion 110, thereby forming a substantially rectangular base of the container 100, also referred to as a bottom. As illustrated in FIG. 1*d*, the first sealing end 102 can be bended about 180 degrees in the intersection between the first end portion 108*a* and the middle portion 110, and in the intersection between the second end portion 108*b* and the middle portion 110. By pressing the outer parts of the end portions 108*a*, 108*b* towards the middle portion 110 a more stable bottom may be achieved such that when the container 100 is standing with the bottom down, as illustrated in FIG. 2, the inwardly folded first and second end portions 108*a*, 108*b* as well as the middle portion 110 are in contact with the underlaying surface. However, in order to illustrate the folding of the container 100, no account has been taken to that the end portions 108*a*, 108*b* are pressed towards the middle portion 110 in FIG. 1*c* and FIG. 1*d*.

Figure 3:
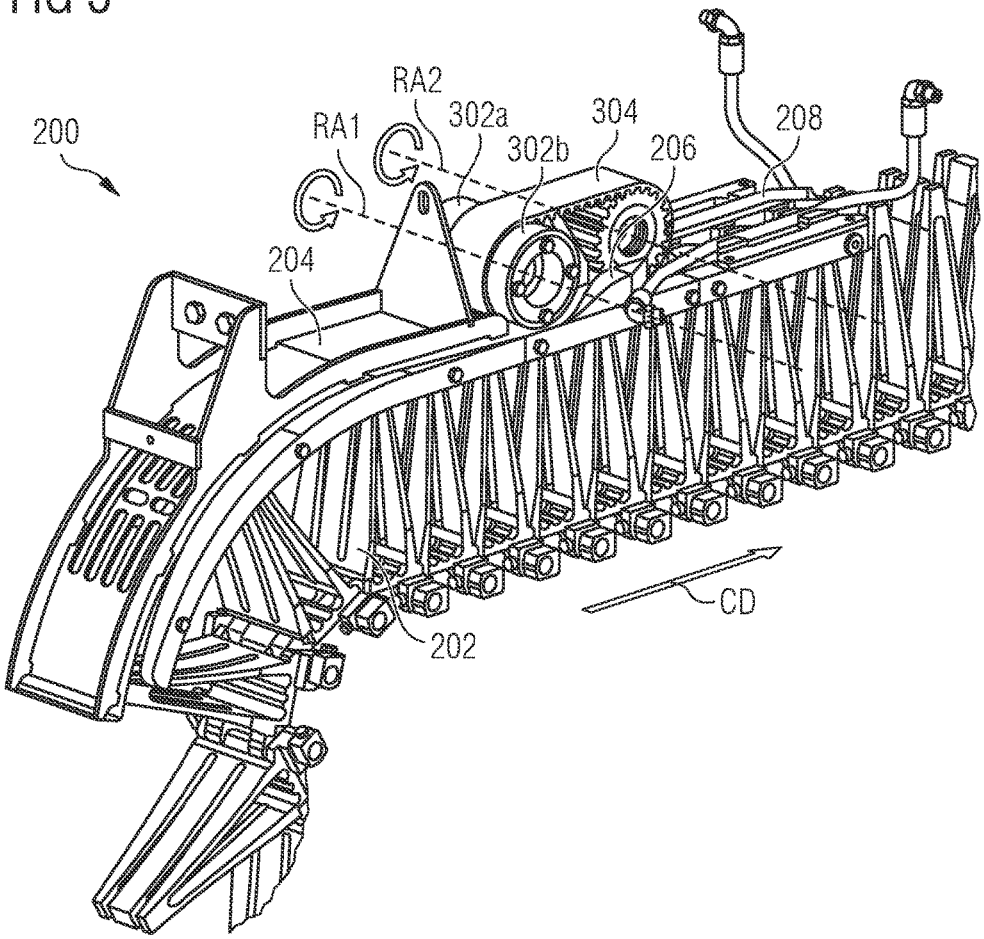
FIG. 3 illustrates an apparatus for folding containers.

FIG. 3 illustrates an apparatus 200 for folding containers 100, as illustrated in FIG. 1*a*, into containers having a rectangular base as illustrated in FIG. 1*d* and FIG. 2.

The container 100 can be fed from the filling machine to the apparatus 200 via a conveyor belt. When reaching the apparatus 200 the container 100 can be introduced with the second sealing end 104 first into a wedge-shaped pocket formed between two consecutive carriers of a conveyor 202 running in a conveyor direction CD. During transportation the first sealing end 102 can be down folded by a plate 204. The plate 204 can be mounted such that a distance between the plate 204 and the conveyor 202 diminishes successively as the container 100 is transported along the conveyor 202. An effect of this is that the containers can successively be transformed from the shape illustrated in FIG. 1*a* to a shape illustrated in FIG. 1*b*.

Next, the container can reach a first flattening wheel 302*a* arranged to flatten the first end portion 108*a* of the first sealing end 102 and a second flattening wheel 302*b* arranged to flatten the second end portion 108*b* of the first sealing end 102. The flattening wheels 302*a* and 302*b* are arranged rotatably around a horizontal axis perpendicular to the conveyor direction CD. In this way the flattening wheels 302*a* and 302*b* may apply a higher downward pressure, since their rotational movement follows the conveyor direction CD, diminshing risk of interference with the conveyor direction CD at higher pressures. In order to make sure that the first sealing end 102 is kept in position, a conveyor belt 304 placed between the first flattening wheel 302*a* and the second flattening wheel 302*b* can be used. As illustrated in FIG. 3, the first flattening wheel 302*a*, the second flattening wheel 302*b* and the conveyor belt 304 may rotate around a common rotational axis RA1. The conveyor belt 304 may further rotate around a rotational axis RA2.

An advantage of flattening the end portions 108*a*, 108*b* is that if any product, with which the container is filled, is present in the end portions this can be moved to the middle portion 110, which makes it possible to achieve thinner and more well-defined end portions. Thinner end portions, in turn, provide for that the folding of the end portions towards the middle portion 110 is facilitated.

Another advantage, if a speed of the first flattening wheel 302*a* and the second flattening wheel 302*b* is equal to a speed of the conveyor 202, is that the first and second end portions 108*a*, 108*b* may be flattened during transportation without generating unwanted shear stress in the container 100.

Next, the end portions 108*a*, 108*b* can be folded upwards 90 degrees, as illustrated FIG. 1*c*, by rails 206 directing the end portions 108*a*, 108*b* as the containers are transported by the conveyor 202. In order to control that the folding is made as intended, that is, in the intersection between the end portion 108*a* and the middle portion 110, and the intersection between the end portion 108*b* and the middle portion 110, the middle portion 110 can be held in correct position by the conveyor belt 304. Thus, the outer ends of the conveyor belt 304 provide for that the folding is made as intended. In order to reduce the risk of deformation of the containers, a speed of the conveyor 202 may be equal to a speed of the conveyor belt 304.

After the end portions 108*a*, 108*b* have been folded upwards about 90 degrees, heating elements 208 can heat the end portions 108*a*, 108*b* as they are transported by the conveyor 202, thereby melting a plastic layer of the containers.

Then, in a final folding sub-step, the end portions 108*a*, 108*b* can be folded inwardly and pressed towards the middle portion 110. Due to the heating of the end portions 108*a*, 108*b*, these attach to the middle portion 110. As the melted plastic layer is cooled down the end portions 108*a*, 108*b* are permanently attached to the middle portion 110. Further, by pressing the end portions 108*a*, 108*b* towards the middle portion 110, a rectangular base can be formed such that when the container is standing with the rectangular base down the container rests on the outer end portions 108*a*, 108*b* and the middle portion 110.

The first and second flattening wheels 302*a*, 302*b* may be attached by screws to a first cogwheel of the conveyor belt

Figure 4:
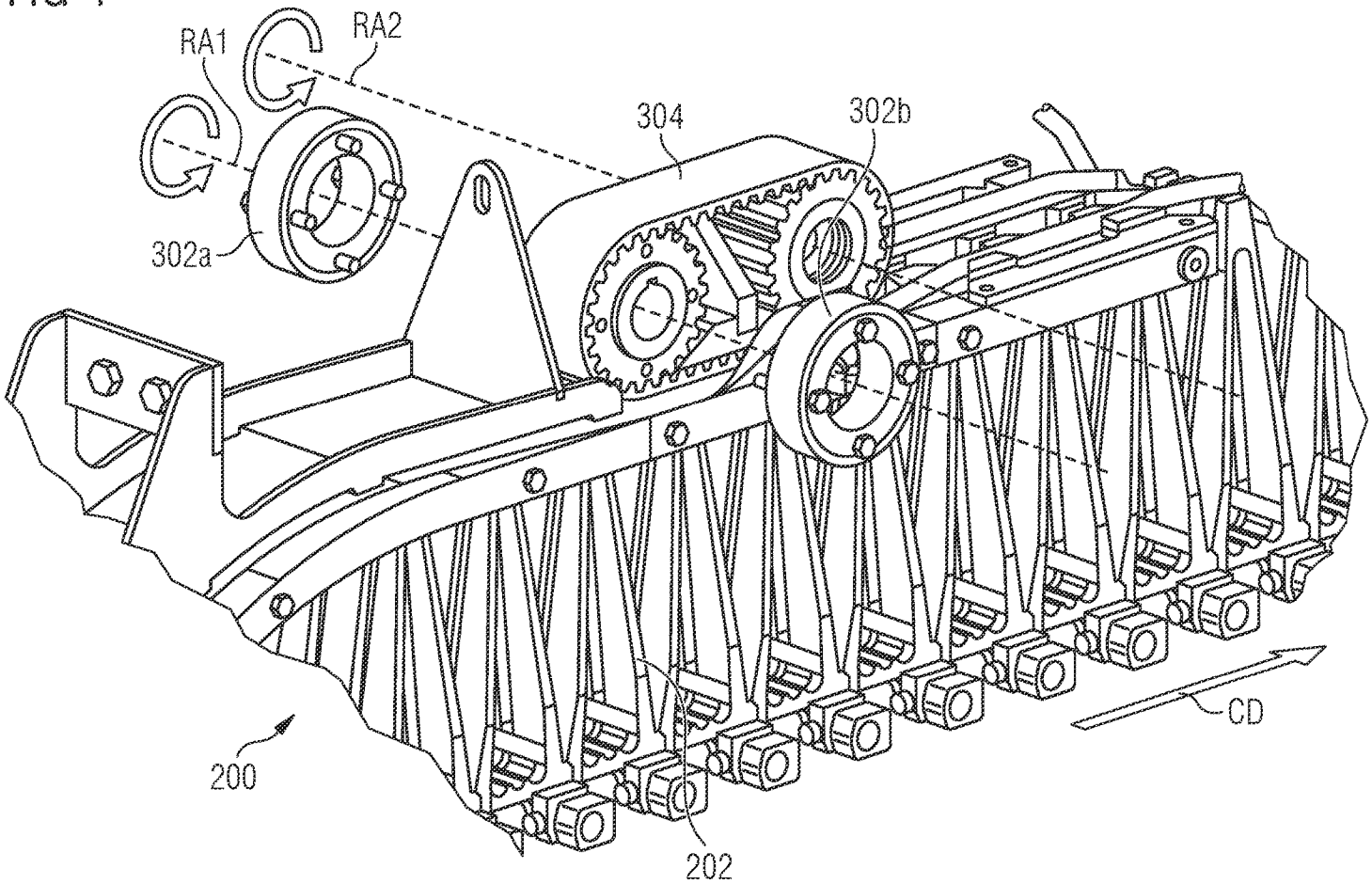
FIG. 4 illustrates the apparatus in further detail.

304, as illustrated in FIG. 4, thereby making it easy to replace the first and second flattening wheels 302*a*, 302*b*.

Figure 5:
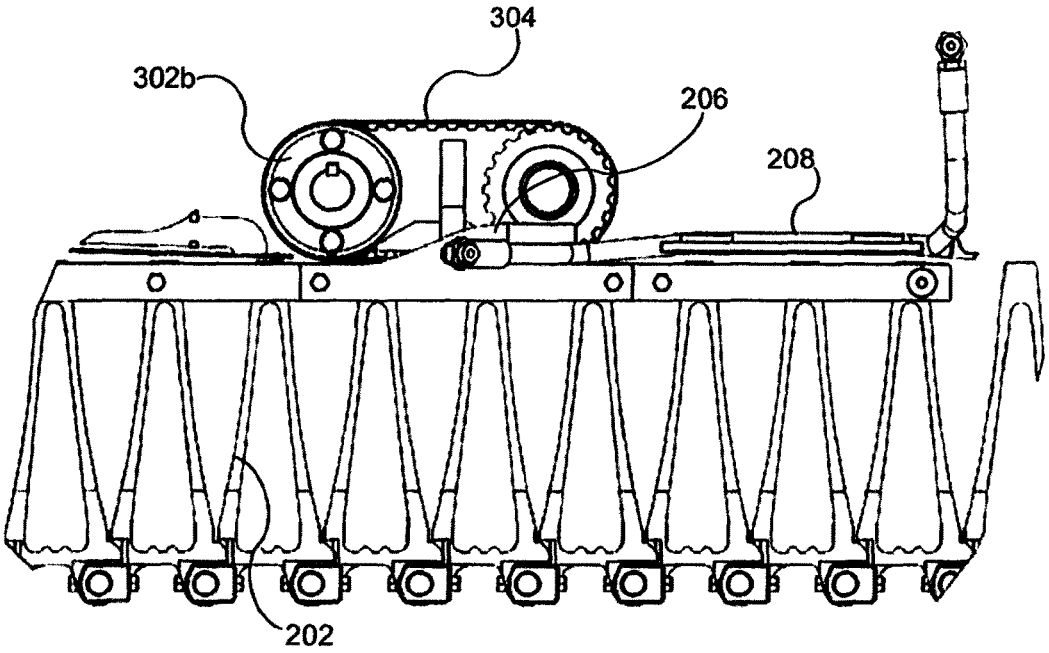
FIG. 5 illustrates a side view of the apparatus.
Figure 6:
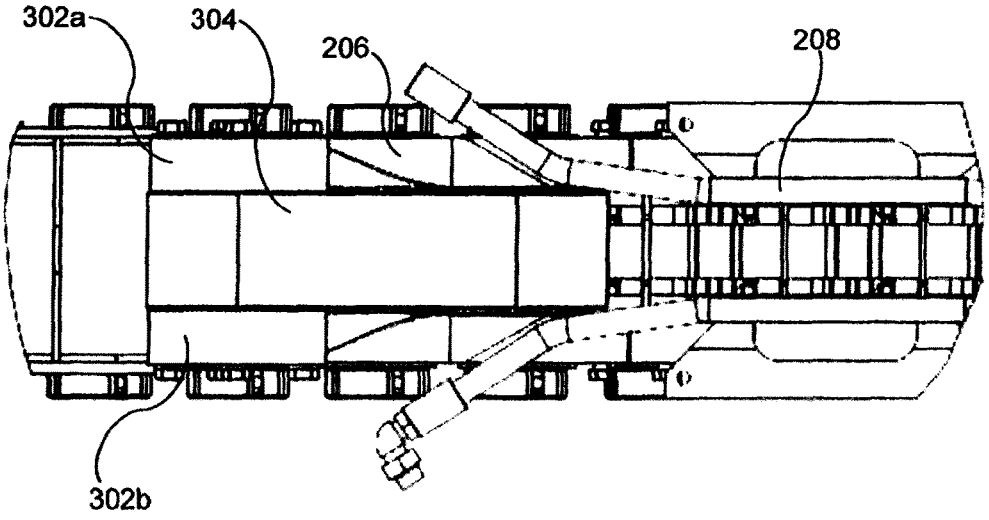
FIG. 6 illustrates a top view of the apparatus.

FIG. 5 illustrates a side view of the apparatus 200 and FIG. 6 illustrates a top view of the apparatus 200. When the end portions 108*a*, 108*b* have been flattened by the flattening wheels 302*a*, 302*b* the rails 206 can fold the end portions 108*a*, 108*b* upwards about 90 degrees. As described above, by holding the middle portion 110 in position by the conveyor belt 304, the risk of improper folding can be reduced. Further, as illustrated, rails having the function as counter elements may be provided in association to the flattening wheels.

Figure 7:
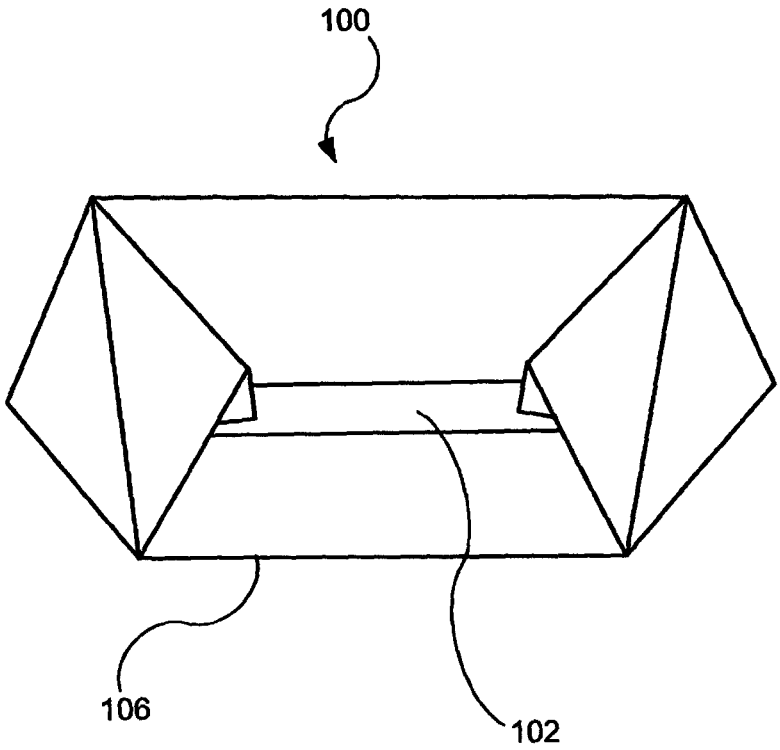
FIG. 7 illustrates an improperly folded container.

One type of improper folding of the container is illustrated in FIG. 7. Such an improper folding may arise if for instance a fixed plate is used instead of a conveyor belt 304. More particularly, by having a fixed plate, friction may arise between the container 100 and the fixed plate, thereby holding back the middle portion 110, but not the outer portions 108*a*, 108*b*, thereby giving rise to an improper folding and unwanted stress in the container 100, and possibly a leaking container.

Figure 8:
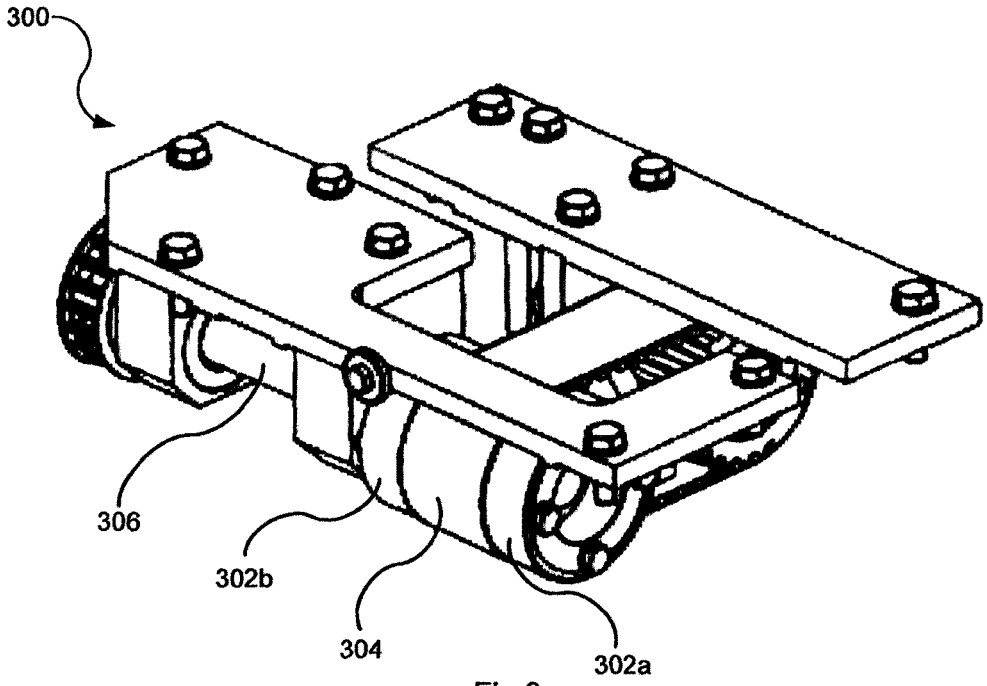
FIG. 8 illustrates a device of the apparatus in further detail.
Figure 9:
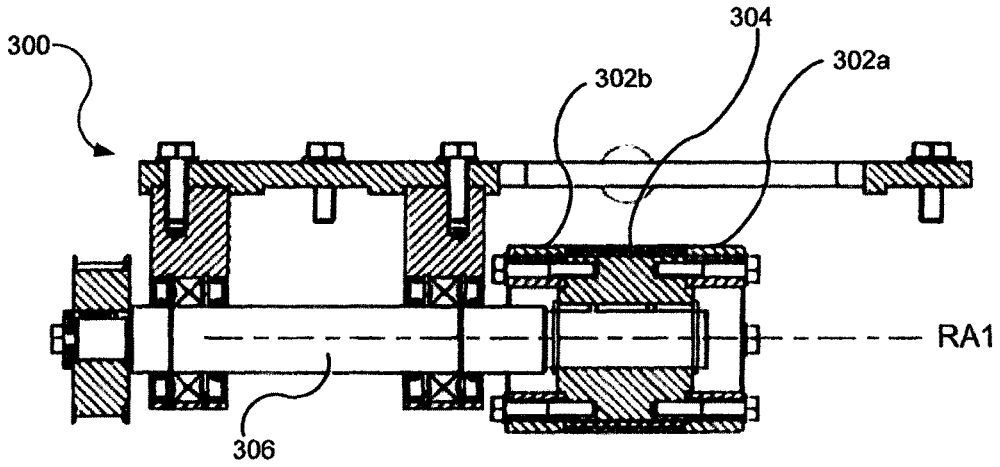
FIG. 9 illustrates a cross-section of the device.

In order to drive the first and second flattening wheels 302*a*, 302*b*, and the conveyor belt 304, a driving shaft 306 may be used, as illustrated in FIG. 8 and FIG. 9. The driving shaft 306 may be common to the first and second flattening wheels 302*a*, 302*b* and the conveyor belt 304. The driving shaft 306 may be connected to an engine (not shown). A device 300 comprising the first and second flattening wheels 302*a*, 302*b*, the conveyor belt 304 and the driving shaft 306 may thus form part of the apparatus 200.

The first and second flattening wheels 302*a*, 302*b* may be provided with rubber coatings. The rubber coatings may be resistant to hydrogen peroxide, which may be used to sterilise the packaging material. Alternatively, the first and second flattening wheels 302*a*, 302*b* may be made of solid rubber.

The conveyor belt 304 may also be provided with a rubber coating resistent to hydrogen peroxide.

Instead of using the first and second flattening wheel 304*a*, 304*b*, a first and second flattening conveyor belt may be used. The first and second flattening conveyor belt may be shorter than the conveyor belt 304, such that the outer ends of the conveyor belt 304 can be used when folding the first and second end portions 108*a*, 108*b* upwards as described above.

Although the apparatus 200 and the device 300 are described with respect to containers having a rectangular base and an unfolded sealing end as a top, the scope of the invention is generally applicable to containers 100 having a sealed end 102 comprising a first end portion 108*a*, a second end portion 108*b* and a middle portion 110, where the first and second end portions 108*a*, 108*b* are inwardly folded and attached to the middle portion 110.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. An apparatus for folding first and second end portions of a container filled with food product and having opposing first and second sealed ends, the first and second end portions being located at the first sealed end of the container, the apparatus comprising:

a conveyor movable in a conveying direction and comprised of a plurality of pockets, each configured to receive one of the containers filled with food product, to move the containers in the conveying direction;

a rotatable first flattening wheel configured to press against and flatten the first end portion of the first sealed end of the container to move food product located in the first end portion of the first sealed end of the container toward a middle portion of the first sealed end of the container located between the first and second end portions;

a rotatable second flattening wheel configured to press against and flatten the second end portion of the first sealed end of the container to move food product located in the second end portion of the first sealed end of the container toward the middle portion of the first sealed end of the container;

the flattening of the first and second end portions by the first and second flattening wheels facilitating folding of the first end portion and the second end portion towards the middle portion of the sealed end of the container; and a conveyor belt positioned on a horizontal axis in between the first flattening wheel and the second flattening wheel, the conveyor belt configured to hold a middle section of the first sealed end of the container folded down.

2. The apparatus according to claim 1, further comprising:

rails arranged downstream of the first and second flattening wheels in the conveying direction and configured to fold the first and second end portions of the first sealed end of the container during transportation of the container by the conveyor so that the first and second end portions are oriented 90 degrees in relation to the middle portion.

3. The apparatus according to claim 2, further comprising:

heating elements arranged downstream of the first flattening wheel, the second flattening wheel, and the rails in the conveying direction and configured to heat the first and second end portions of the first sealed end during transportation of the container by the conveyor.

4. The apparatus according to claim 1, further comprising:

heating elements arranged downstream of the first and second flattening wheels in the conveying direction and configured to heat the first and second end portions of the first sealed end during transportation of the container by the conveyor.

5. An apparatus for folding first and second end portions of a container filled with food product and having opposing first and second sealed ends, the first and second end portions being located at the first sealed end of the container, the apparatus comprising:

a conveyor movable in a conveying direction and comprised of a plurality of pockets, each configured to receive one of the containers filled with food product, to move the containers in the conveying direction;

a rotatable first flattening wheel configured to press against and flatten the first end portion of the first sealed end of the container to move food product located in the first end portion of the first sealed end of the container toward a middle portion of the first sealed end of the container located between the first and second end portions;

a rotatable second flattening wheel configured to press against and flatten the second end portion of the first sealed end of the container to move food product located in the second end portion of the first sealed end of the container toward the middle portion of the first sealed end of the container;

the flattening of the first and second end portions by the first and second flattening wheels facilitating folding of the first end portion and the second end portion towards the middle portion of the sealed end of the container;

a plate fixed in position upstream relative to the first and second flattening wheels in the conveying direction, the plate being configured to fold the first sealed end of the container into a folded down position during transportation of the container by the conveyor; and a conveyor belt positioned on a horizontal axis in between the first flattening wheel and the second flattening wheel, the conveyor belt configured to hold a middle section of the first sealed end of the container folded down.

6. The apparatus according to claim 5, further comprising: rails arranged downstream of the first and second flattening wheels in the conveying direction and configured to fold the first and second end portions of the first sealed end of the container during transportation of the container by the conveyor so that the first and second end portions are oriented 90 degrees in relation to the middle portion.

7. The apparatus according to claim 5, wherein a speed of the conveyor belt is equal to a speed of the first flattening wheel and a speed of the second flattening wheel.

8. The apparatus according to claim 5, wherein the conveyor belt, the first flattening wheel, and the second flattening wheel have a common driving shaft.

* * * * *